United States Patent [19]

Giori et al.

[11] Patent Number: 4,552,066

[45] Date of Patent: Nov. 12, 1985

[54] COMBINED SHEET FED ROTARY PRINTING MACHINE FOR SECURITIES, IN PARTICULAR BANK-NOTES

[75] Inventors: Gualtiero Giori, Lonay, Switzerland; Albrecht J. Germann, Würzburg, Fed. Rep. of Germany

[73] Assignee: De La Rue Giori S.A., Switzerland

[21] Appl. No.: 675,848

[22] Filed: Nov. 28, 1984

[30] Foreign Application Priority Data

Jul. 24, 1984 [EP] European Pat. Off. ..... 84810368.5

[51] Int. Cl.[4] ..... B41F 9/02; B41F 13/24

[52] U.S. Cl. ..... 101/152; 101/248

[58] Field of Search ..... 101/152, 175, 177, 183–185, 101/136–137, 248, 170

[56] References Cited

U.S. PATENT DOCUMENTS

| | | | |
|---|---|---|---|
| 3,557,692 | 1/1971 | Lee | 101/183 |
| 3,701,464 | 10/1972 | Crum | 101/248 X |
| 3,746,957 | 7/1973 | Forster et al. | 101/183 |
| 3,858,052 | 12/1974 | Luska | 101/248 X |
| 4,394,835 | 7/1983 | Gertsch et al. | 101/177 |
| 4,428,287 | 1/1984 | Greiner | 101/248 |
| 4,484,522 | 11/1984 | Simeth | 101/248 |

*Primary Examiner*—E. R. Eickholt

*Attorney, Agent, or Firm*—Kane, Dalsimer, Kane, Sullivan and Kurucz

[57] ABSTRACT

The printing machine has a multi-color offset printing unit, behind this a sheet conveying device, and an intaglio printing unit to which the sheets printed and provided with register marks in the first printing unit are transferred by the conveying device. The conveying device comprises a detector system responding to these register marks, and a register drum. Each of the two printing units and the register drum have their own drive mechanisms mechanically independent of each other. The drive mechanism for the second printing unit is controlled in dependence upon the speed of the first printing unit, and the drive mechanism for the register drum is controlled on the one hand in dependence upon the speed of the second printing unit and on the other hand in dependence upon the register deviation measured in the circumferential direction. Further, on the register drum are disposed devices for correcting side register and any skew of a sheet in dependence upon the measured register deviations. A second detector system reads the position of the abovementioned register marks relative to further register marks applied in the intaglio printing unit, and if necessary performs fine correction of register.

9 Claims, 3 Drawing Figures

COMBINED SHEET FED ROTARY PRINTING MACHINE FOR SECURITIES, IN PARTICULAR BANK-NOTES

FIELD OF INVENTION

The invention relates to a combined sheet fed rotary printing machine for securities, in particular bank-notes, with a first printing unit, a second printing unit formed by an intaglio printing unit, and a conveying device connecting the two printing units for transferring the sheets.

PRIOR ART

One known combined rotary printing machine of this kind (German Pat. No. 24 11 691) consists of a multicolour offset printing unit and a multi-colour intaglio printing unit, with which one side of securities can be printed first in offset printing, in particular to produce a safety background, and then in intaglio printing, in particular to produce the main design. If the conveying device between the two printing units is equipped with a sheet turning device, one side of the sheet can be printed in offset printing and the other side in intaglio printing in a single run as well.

To transfer the sheets in register from the first to the second printing unit, it is necessary to design and set the gripper assemblies, which convey the sheets between the printing units and which are mounted on chain gripper system and/or on conveying drums, with sufficient precision so that all the sheets are moved in a precisely defined manner. With respect to keeping exact register, which is very important particularly in combined multicolour rotary printing machines, and especially when printing bank-notes, experts have hitherto relied on the sheet conveying system which was supposed to ensure transfer of the sheets in register.

However, elaborateness of construction is considerable in gripper assemblies of this kind, which have to maintain perfect register during the whole of the conveying process and whose grippers must therefore keep the sheet immovable with sufficiently great force and must themselves be guided and controlled in a precisely defined manner. Moreover, the setting time which is necessary for precision adjustment of the two printing units and conveying system may amount to several days. Furthermore, the demands which are being made on the print quality of securities are ever increasing. Of course, in modern multicolour offset printing machines, transfer of the sheets in register is ensured, but difficulties arise in combined printing machines of the kind mentioned hereinbefore. As the two printing units of combined printing machines of this kind are generally provided with a continuous longitudinal shaft for the purpose of synchronous drive, repercussions of the hight impacts generated in the intaglio printing unit on the sheet conveying system and possibly on the first printing unit may impair transfer of the sheets in register. As is known, during operation of an intaglio printing machine, which operates with far greater squeeze than for example an offset printing machine, periodic impacts are produced each time impression increases and decreases between the intaglio printing plates mounted on the plate cylinder and the impression cylinder on the one hand, and the wiping cylinder on the other hand, resulting in a kind of pendulum oscillation in a circumferential direction. These shocks, and in general the changeover between the relatively low impression stress in the first printing unit and the high stresses in the intaglio printing unit, impair register.

The maintenance of perfect register is furthermore particularly critical when a sheet turning device is provided between the two printing units, as tolerances in the sheet position in register can scarcely be avoided after turning.

Also, the high operating speed of modern sheet fed printing machines, which can print up to more than 10,000 sheets an hour, renders transfer in good register at the correspondingly high conveying speeds more and more difficult.

Numerous devices with which the position of sheets to be printed or of printed sheets can be corrected or altered are already known. Thus, for example, from German Pat. No. 19 34 029 has become known a cylinder of a printing machine with a gripper assembly, in which the gripper spindle carrying the grippers and the gripper support bar form a structural unit which is mounted laterally displaceably in the cylinder and can be displaced in a transverse direction by means of a control device for the purpose of lateral displacement of the sheet. This control device may consist in particular of a plate with a cam, and a roller which is mounted at the end of the displaceable gripper assembly and which rolls over the cam. This known cylinder is intended to permit a sheet to be offset laterally from normally deposited sheets, with a counter mechanism in each case determining the number of consecutive normally deposited sheets.

A device known from German Offenlegungsschrift 20 46 602 for feeding and aligning sheets in a printing machine operates with a measuring head and, connected to the output of the measuring head, a measurement control means which performs individual lateral displacement of sheets by means of a sliding suction bar or of an axially displaceable stop drum or intermediate drum which is displaceable by means of a controllable wedge or a controllable hydraulic cylinder. Respective measurement of the effective sheet position, that is, the actual position, is performed in this case according to German Offenlegungsschrift 20 46 602 preferably photoelectrically, in such a way that the light radiation emanating from a light source and measured by a photoelectric cell is confined by a triangular aperture to a wedge shape, and is moreover partly concealed by the side edge of the sheet. In this way, according to the varying lateral positions of the approaching sheets, a greater or lesser amount of light radiation is allowed to pass through to the photoelectric cell, which results in a corresponding photoelectric current and hence an electric measurement signal of corresponding value. This measurement signal represents the actual position of a sheet, and is compared with an electric signal representing the desired or nominal position for the purpose of generating a control signal to correct register.

Moreover, in German Pat. No. 1 175 695 is described a device in multicolour sheet fed rotary printing machines, for controlling the maintenance of register of the print by deforming the leading edge of the sheet. For this purpose, the gripper assembly which is provided in a sheet guide device and which consists of the gripper rest and the gripper shaft carrying the grippers, is divided into separate sections along the leading edge of the sheet, and at the joints between these sections are disposed carriages which engage both ends of both gripper shaft and gripper support and are displaceable in or counter to the direction of sheet travel or at an angle thereto. The individual sections of the gripper shaft are mounted in self-aligning roller bearings, and the sections of the gripper rest are pivotable about pins in hinge fashion. The carriages can be displaced by means of cam-operated rockers, the position of the cams being adjustable by means of an infinitely variable drive mechanism. The sheet guide device on which the displaceable gripper assembly is mounted may be a contact drum, an impression cylinder, a transfer drum or a chain conveyor. This known device according to German Pat. No. 1 175 695 is intended to compensate for the changes in the paper caused by moisture and squeeze and hence improve maintenance of register.

None of the known devices for controlling sheet position has, however, been used hitherto in a combined sheet fed rotary printing machine of the kind described hereinbefore, because the quality of register stability of the sheet conveying system itself was satisfactory and it was clearly considered to be not practicable or too complicated to incorporate register corrections of the sheets within the synchronously driven machine assembly.

SUMMARY OF THE INVENTION

The object of the present invention is to ensure a perfect register stability when transferring the sheets from the first to the second printing unit in combined printing machines of the kind described, and as far as possible to exclude repercussions of the intaglio printing unit, which undergoes pendulum-like vibrations on account of the impact-like increases and decreases in impression, on the remaining components of the machine.

This object is achieved according to the invention by the characteristics specified in the patent claim 1.

Due to mechanical separation of the drive mechanisms of the two printing units, on the one hand mechanical repercussion of the impacts of the intaglio printing unit on the remaining machine components is to a large extent prevented, and on the other hand adjusting of the combined machine is facilitated considerably, and consequently also the time required for this greatly reduced. Further, deviations from perfect register can be corrected automatically before entry of the sheets into the second printing unit.

Preferably, the register drum is controllable by an independent drive which is controlled in dependence upon the speed of the second printing unit and which is furthermore controlled in dependence upon the measured deviation from circumferential register in order to correct the latter; corrections of side register and, if necessary, skew of the sheets are performed preferably by devices on the register drum, in particular by controllable and correspondingly displaceable sheet grippers.

In order to be able to carry out any register corrections in case of need even more precisely, behind the point at which the sheets are printed in the intaglio printing unit there may be provided a second detector system which measures the positions of register marks applied in the intaglio printing unit relative to the register marks applied in the first printing unit, and whose error signals are also used to control the devices which correct register deviations, in particular the register drum.

Appropriate developments of the combined printing machine according to the invention are shown in the subordinate claims. To perform register corrections in dependence upon the measured register deviations, devices which are known per se, e.g. these mentioned in the above introduction, and whose control and adjustment mechanisms are if necessary to be adapted accordingly, may be used.

BRIEF DESCRIPTION OF THE DRAWINGS

The invention is illustrated in more detail by a preferred embodiment thereof illustrated by way of example in the accompanying drawings.

DESCRIPTION OF THE PREFERRED EMBODIMENTS

Figure 1:
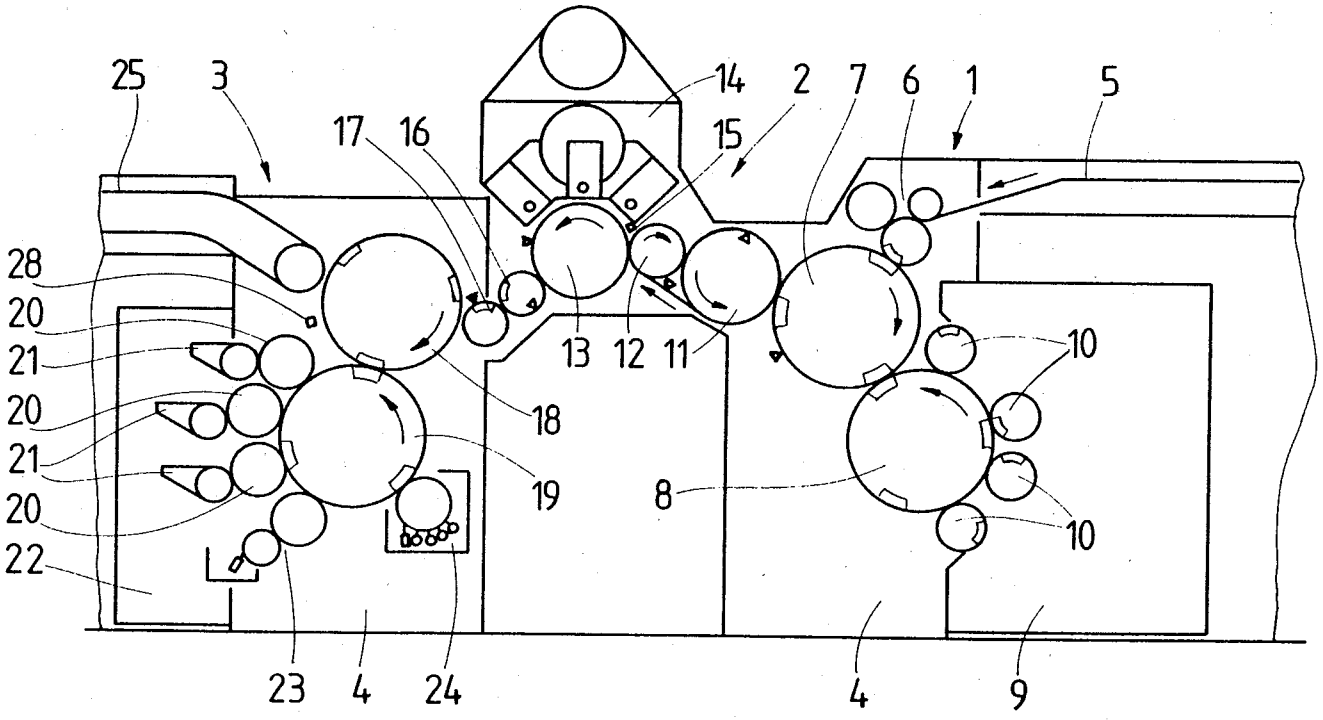
FIG. 1 shows a schematic side view of a combined sheet fed rotary printing machine according to the invention.

According to FIG. 1, the combined printing machine consists of a first printing unit 1, which is in the example under consideration a four-colour dry offset printing unit, a sheet conveying device 2, and a second printing unit 3 in the form of a multi-colour intaglio printing unit, consisting of a three-colour intaglio printing unit in the example under consideration. The first printing unit does not need to be a dry offset printing unit; on the contrary, it can be a multi-colour printing unit operating by any printing method.

The first printing unit 1 comprises a sheet supply device 6 with a stop drum and a transfer drum for the sheets 5 arriving along a transport path from a sheet feeder, an impression cylinder 7, a blanket cylinder 8 coacting with the latter, and four offset plate cylinders 10 which carry dry offset printing plates. These printing plates, which in each case exhibit a partial image, are inked by inking units (not shown) associated with them, each with a given colour, and all the inked partial images are transferred to the blanket cylinder 8. All the inking units are mounted on a frame 9 which can be moved away from the main frame 4 of the machine. The directions of rotation of the cylinders are indicated by curved arrows. The sheets 5 are printed during passage between impression cylinder 7 and blanket cylinder 8, then taken over in register by the conveying device 2.

The conveying device 2 consists of an adjustable sheet turning device which is known per se, with a large cylinder 11 and a small cylinder 12, a drying cylinder 13 which is mounted beneath a drier 14 preferably provided with ultraviolet lamps, a register drum 16, and a conveying drum 17. The position of the printed side of the sheets passing through the conveying device 2 is in each case indicated by a small triangle. Opposite a circumferential section of the drying cylinder 13, near the point of sheet transfer from the cylinder 12, is mounted a detector system 15 for reading the register marks on the sheet 5, which have been applied by an offset printing plate in the first printing unit 1. This detector system 15 and the operation of the register drum 16 will be further explained below.

In order to obtain maximum-precision guidance of the sheets passing over the register drum 16, the axes of the drying cylinder 13, register drum 16 and conveying drum 17 are arranged in a straight line or at least approximately in a straight line.

The known sheet turning device operates, when it turns the sheets as in the example under consideration, as follows: as soon as the sheet held by grippers at its leading edge on the large cylinder 11 has passed completely through the gap between the large cylinder 11 and the small cylinder 12, the grippers mounted on the small cylinder 12 are controlled in such a way that they grip the trailing edge of the sheet on the large cylinder 11. These grippers are pivotable about an axis parallel to the cylinder axis, and at the moment when they grip the trailing edge of the sheet they are directed forwardly in the direction of rotation of the small cylinder 12. Immediately after they have gripped the trailing edge of the sheet, they are pivoted backwards, and what was the trailing edge of the sheet now being drawn over the small cylinder 12 now becomes the leading edge of the sheet, which is subsequently released by the grippers of the large cylinder 11 and drawn over the small cylinder 12 in the direction of the straight arrow. In this way, the printed side of the sheet faces outwards when the sheet passes onto the drying cylinder 13, and in the second printing unit the other side of the sheet, which has not yet been printed, is printed.

If the same side of the sheet which was printed in the first printing unit 1 is to be subjected to additional intaglio printing in the second printing unit 3, the sheet turning device is set so that conventional sheet transfer between the cylinders 11 and 12 takes place without turning of the sheets. The printed side of the sheet then faces inwardly on the drying cylinder 13, which however has no significance, since any set-off of the incompletely dried ink can if necessary take place in the intaglio printing unit, under the effect of the pressure of the impression cylinder against the intaglio printing plates which are, however, wiped before each new printing process.

The second printing unit 3, the intaglio printing unit, consists of an impression cylinder 18 onto which the sheets pass from the conveying drum 17, a plate cylinder 19 carrying intaglio printing plates and coacting with the impression cylinder 18, three inking rollers 20 which are inked by inking units 21 in different colours and which ink the intaglio printing plates on the plate cylinder 19, a prewiping device 23 which is known per se, and the actual wiping device 24 which comprises a wiping cylinder. The inking units 21 are mounted on a frame 22 which can be moved away from the main frame 4. As the sheets have been turned, they are printed on the side not yet printed, in intaglio printing, on passage between the impression cylinder 18 and the plate cylinder 19, and then taken over by a chain conveyor 25.

Opposite the circumferential section of the impression cylinder 18 on which the sheets, after intaglio printing, pass to the chain conveyor, is mounted a second detector system 28 whose operation will be described below.

In the example under consideration, therefore, the sheets are subjected to four-colour offset printing on one side, and three-colour intaglio printing on the other side. The offset printing preferably involves the safety background, such as securities and especially banknotes are as a rule provided with, and the intaglio printing involves the main design. If the sheet is not turned, both prints are applied to one side of the sheet.

Figure 3:
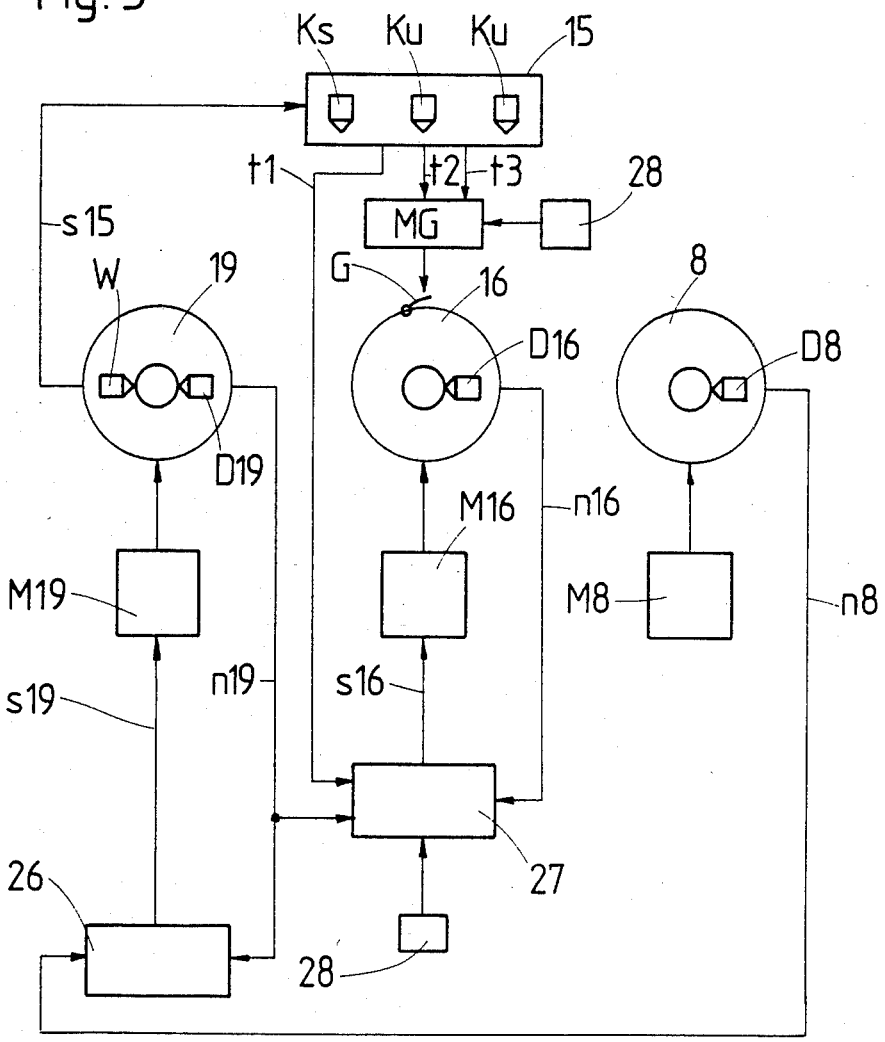
FIG. 3 shows a block diagram of the control and adjustment apparatus of the machine.

FIG. 3 shows the adjustment and control apparatus for the machine described. The cylinders of the printing unit 1 are set in rotation by a drive M8 comprising a motor, the blanket cylinder 8 being driven in the example under consideration. The remaining cylinders of the printing unit 1 as well as the cylinders 11,12 and 13 of the conveying device 2 are kinematically coupled to the blanket cylinder 8 in a known manner for the purpose of synchronous rotation.

To drive the printing unit 3, a drive M19 comprising a motor is used, which in the example under consideration drives the plate cylinder 19, while the remaining cylinders and rollers of the intaglio printing unit as well as the conveying drum 17 are kinematically coupled to the plate cylinder 19. In order to obtain movement of the printing unit 3 in synchronisation with movement of the printing unit 1, the drive M19 is regulated in dependence upon the speed of the printing unit 1. For this purpose, on the shaft of the blanket cylinder 8 is disposed a speed sensor D8 which provides an electric signal n8 representing the nominal speed. A speed sensor D19 disposed on the shaft of the plate cylinder 19 provides an electric signal n19 representing the actual speed of the second printing unit 3. The two signals n8 and n19 are fed to a circuit arrangement 26 which generates a control signal s19 corresponding to the difference between nominal and actual values, for controlling the drive M19. The two printing unit drives are thus not mechanically connected by a longitudinal shaft, by synchronised with each other purely electrically, by a so-called synchro system.

Since the two drives M8 and M19 are mechanically independent of each other, mechanical repercussions by the intaglio printing unit on the conveying device 2 and printing unit 1 are prevented. In this way are to a large extent avoided basically all those possible register errors which may arise due to the fact that the sheets alter their positions in good register during transfer to the second printing unit, as a result of the high impacts occurring during intaglio printing. Moreover, the mechanically independent printing units 1 and 3 can be adjusted considerably more easily and in a much shorter time than the hitherto known combined printing machines.

In order nevertheless to correct any register deviations such as may occur in particular when the sheets 5 are turned, the sheets are provided at their edges with the above-mentioned register marks which—as further explained below—are read by the detector system 15, and by means of the register drum 16 and a register correcting device mounted thereon, in particular a displaceable gripper assembly, the position of an individual sheet can be corrected in dependence upon the measured register deviations. Possible auxiliary control by the detector system 28 will not be dealt with till later.

The register drum 16 is driven by a drive mechanism M16 which is independent of the printing unit drive mechanism M8 and M19, in dependence upon the speed of the second printing unit 3. For this purpose, the electric signal n19 which is generated by the speed sensor D19 and now used as nominal speed, and an electric signal n16 representing the actual speed of the register drum 16 and generated by a speed sensor D16 on the shaft of the register drum 16, are fed to a circuit arrangement 27. The latter generates a control signal s16 proportional to the difference between nominal and actual value, for corresponding control of the drive mechanism M16 which is thus electrically synchronised with the speed of the second printing unit 3. When register deviations are measured in the circumferential direction, a short-term small acceleration or deceleration can be superimposed temporarily on synchronous rotation of the register drum 16, in such a way that the sheet concerned is slightly displaced in the direction of transport or in the opposite direction for the purpose of correction of register deviation. For this purpose, the drive mechanism M16 for the register drum 16 preferably consists of a disc-armature motor whose armature has only a low mass and therefore responds practically without delay to control commands for rapid short-term speed variation, or a stepping motor.

Figure 2:
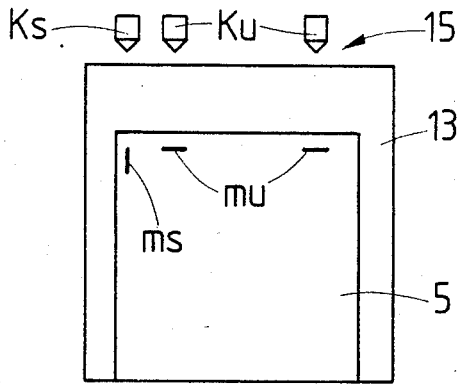
FIG. 2 shows a schematic view of a sheet with its register marks moving past the detector system.

In the example under consideration, each sheet 5 as shown schematically in FIG. 2 comprises at the leading edge two circumferential register marks mu which are applied at the same level in the printing unit 1, and at one side edge a side register mark ms. The two register marks mu are located close to the side edges of the sheet, and serve to measure both register deviation in the circumferential direction and possible skew of the sheet. The detector system 15 has two measuring heads Ku which read the register marks mu, and a measuring head Ks for reading the register mark ms. The position of these measuring heads in relation to a sheet 5 disposed on the drying cylinder 13 is indicated schematically in FIG. 2.

An angular position pulse generator W (FIG. 3) which is mounted on the shaft of one of the cylinders of the second printing unit 3, in the example under consideration the shaft of the plate cylinder 19, delivers at those moments when the register marks pass by the detector system 15 and are to be read, an electric signal s15 which triggers measurement and simultaneously defines the nominal value of the correct register position of the sheet 5 in question in the circumferential direction. The time of actual reading of the register marks mu by the measuring heads Ku defines the actual value of the position of the sheet; this applies provided that the sheet is precisely aligned in the direction of transport and is not askew (the eventuality of skew will be explained below), and therefore both register marks mu are read simultaneously by the two measuring keads Ku. If a difference between nominal and actual values occurs, a logic circuit associated with the measuring heads Ku delivers a corresponding error signal t1 which is fed to the circuit arrangement 27 and causes the latter to alter the speed of the register drum 16 for a short time and temporarily, in such a way that the sheet 5 in question, as soon as it is located on the register drum 16, is returned to its position in good register.

The measuring head Ks detects, by reading the side register mark ms, a register deviation in the lateral direction. For this purpose, the measuring head Ks may consist of a number of photosensitive cells, e.g. phoeodiodes, which are arranged in a row adjacent to each other transversely to the direction of travel of the sheets. the measuring head Ks can also operate with a bundle of lightconducting glass fibres whose light incidence surfaces are arranged in a row and directed onto the edge of the sheet. The image of the edge of the sheet with the register mark is projected onto the photosensitive cells or light incidence surfaces of the glass fibres, so that in this way there is measured the point at which the register mark ms is located within the measurement zone covered by the measuring head Ks. If a deviation is detected from the nominal position, defined for example at the centre of the measurement zone, then a logic circuit associated with the measuring head Ks generates an error signal t2 which corresponds to the difference between nominal and actual positions and controls a drive mechanism MG for the device G for correcting side register.

This device G is mounted on the register drum 16 and may consist of a gripper assembly which is displaceable in the transverse direction, for example by a fluid-operated cylinder. The principle of adjustment of this kind is known for example from German Patent No. 19 34 029, which has already been mentioned in the introduction.

In order to measure side register, there may also be used, instead of the register mak ms and the measuring head Ks described, the photoelectric measuring device which is described in the above-mentioned German Offenlegungsschrift No. 20 46 602; in this device is measured the light radiation which is limited by a triangular aperture and partly concealed by the side edge of the sheet in question, and whose intensity, which is dependent on the lateral position of the sheet, defines the actual position of the sheet relative to the predetermined nominal position.

In order also to detect any skew of a sheet, two register marks mu are provided, which are located at the same level, and accordingly two measuring heads Ku, as mentioned above. If the two register marks mu are detected simultaneously by the two measuring heads Ku, the sheet is oriented in its aligned position, and the time of measurement simultaneously directly defines the actual value of the sheet position in the circumferential direction. If, however, the two register marks mu are detected by the measuring heads Ku at different times, this means that the sheet is disposed slightly obliquely to the direction of travel, in one or another direction. In this case, a corresponding error signal t3 is generated in a logic circuit associated with these measuring heads Ku from the order in which the two measuring heads Ku respond, and from the difference between the response times; the error signal t3 serves to control a drive mechanism for a device for aligning the sheet. In this case, the time which defines the actual value of sheet position in the circumferential direction and which is compared with the nominal value for the purpose of correction of circumferential register deviation, is in the middle between the two times at which the measuring heads Ku measure the register mark mu associated with them.

In the example under consideration according to FIG. 3, the drive mechanism MG and the device G controlled thereby, which correct side register, are also used to correct skew of the sheet. For this purpose, the griper assembly may be not only transversely displaceable, but also pivotable about an axis oriented radially relative to the register drum 16, whereby any skew of the sheet can be compensated; the assembly may comprise, in a known manner, a correspondingly displaceable and pivotable beam to which one edge of the sheet is laid.

Furthermore, there may also be used a displacement mechanism after the fashion of the device described in German Pat. No. 1 175 695, which was mentioned in the introduction to the specification and in which the gripper assembly is divided into separate sections which are displaceable by means of carriages independently of each other in the circumferential direction and in the transverse direction. By this means, both side register and skew of the sheet can be corrected.

It is also possible to measure circumferential register deviation and possible skew of the sheet separately, by using the two register marks mu shown in FIG. 2, which are located near the side edges of the sheet 5, only for the detection of skew, and using a furhter register mark, which is applied in the middle of the leading edge of the sheet and is read by a furhter measuring head, for the detection of circumferential register deviation.

The precision with which the detector system 15 measures register deviations essentially depends on how precisely the angular position pulse generator W on the shaft of the plate cylinder 19 is adjusted angularly with respect to the position of the intaglio printing plates mounted on the plate cylinder 19. The signal s15 emitted by this angular position pulse generator W should represent the actual value of the position of the intaglio printing plates on the plate cylinder 19, and hence the nominal value for the register position of the sheet when passing by the detector system 15. If, when installing the intaglio printing unit, in particular when mounting the intaglio printing plates, the relative angular positions of the angular position pulse generator W and of the intaglio printing plates are not adjusted with absolute precision, or if during the course of operation small inaccuracies occur in respect of these relative positions, the measurements of the detector system 15 are subject to errors systematically.

In order to eliminate this possible source of errors and obtain an actual position of the intaglio print image which is independent of the precision of adjustment of the angular position pulse generator W and intaglio printing plates, in the example under consideration there is provided a second detector system 28 which measures and compares the positions of additional register marks applied to the sheet in the intaglio printing unit 3 and the register marks applied in the offset printing unit 1. For this purpose, the detector system 28 is mounted according to FIG. 1 on the circumference of the impression cylinder 18, between the point at which the sheets are subjected to intaglio printing and the chain conveyor 25 which removes the sheets.

The register marks applied by the intaglio printing plates thus represent the actual position of the intaglio printing plates and intaglio printed image, and must, if the offset printed image and the intaglio printed image are in perfect register, have a precise predetermined position relative to the register marks which are applied in the offset printing unit 1 and which represent the actual position of the offset printed image. The register marks applied in the intaglio printing unit 3 may have the same number of marks and the same configuration as the register marks applied in the offset printing unit and illustrated in FIG. 2, and may for example coincide with these exactly, if the register is correct.

The detector system 28, whose construction may correspond basically to the detector system 15, is arranged to measure differences in the positions of the mutually corresponding register marks of offset printing unit and intaglio printing unit, and to transmit corresponding error signals. These error signals likewise control, as illustrated schematically by FIG. 3, the circuit arrangement 27 for controlling the register drum drive mechanism M16, as well as the drive mechanism MG for the device G.

The detector system 28 thus detects on the ready printed sheets any register deviations in the circumferential direction, in the lateral direction and in respect of skew, and delivers corresponding correction signals for alignment of the subsequent sheets in register. Therefore the register corrections performed by the detector system 15 may be referred to as presetting of register, which in many cases may be sufficient, while any fine corrections of register are performed by the detector system 28.

The register drum 16 and all devices and components used for correction of register deviations are, after passage of each sheet whose position has been corrected, returned to their neutral or zero position, from which they can again if necessary perform corrections of sheet position on passage of the subsequent sheet.

In the example described above according to FIG. 1, the register drum 16 is driven by its own independent drive mechanism, so that register corrections in the circumferential direction are possible by temporarily changing speed, and on the register drum 16 are mounted controllable sheet gripper assemblies with which a sheet can be displaced relative to the drum surface for the purpose of correction of side register or skew.

However, numerous modifications are possible. Instead of providing a gripper assembly which is displaceable transversely to the register drum 16, the register drum 16 itself may be axially displaceable and adjustable by a suitable control device in dependence upon the error signal t2; the principle of adjustment of this kind is known from German Offenlegungsschrift No. 20 46 602, which was mentioned in the introduction.

Correction of skew may also be performed by correspondingly controlled adjustment of the register drum 16 itself, which for this purpose is mounted in self-aligning bearings which allow tilting of the register drum 16 in one or another direction, necessary adjustments of this kind being of course only very small.

If occasion should arise, the devices for correcting side register and skew may also be mounted on components of the conveying device 2 which are mounted behind the register drum 16.

The arrangement may also be fundamentally such that the register drum 16 has no independent drive mechanism, but is mechanically connected to the drive mechanism of the intaglio printing unit 3 and is driven positively thereby, so that the kinematic division of the two halves of the combined machine is located between the register drum 16 and the drying cylinder 13. In this case, the register drum 16 is equipped with a controllable adjustable gripper assembly which allows both displacement of the sheet in the circumferential direction and the lateral direction, as well as with respect to any skew.

The combined printing machine according to the invention allows the ever increasing demands on quality of securities, in particular bank-notes, to be met for the first time, as maintenance of register, which is essentially a deciding factor of this quality, can be ensured when transferring the sheets. Moreover, economy of operation of combined sheet fed printing machines of this kind described is increased, since in particular the expenditure on installation of the combined printing machine is considerably reduced.

The invention is not limited to the practical example described, but permits manifold variants, in particular with respect to the type of first printing unit, the arrangement and construction of the sheet conveying device, register drum and devices for correcting register including the arrangement of the register marks, and the electric drive mechanisms.

What is claimed is:

1. Combined sheet fed rotary printing machine for securities, in particular bank-notes, comprising a first printing unit, a second printing unit formed by an intaglio printing unit, and a conveying device connecting the two printing units for transferring the sheets, said printing units each have an independent drive mechanism without a continuous longitudinal shaft, the drive mechanism of the second printing unit being controlled in dependence upon the speed of the first printing unit, a detector system mounted in the conveying zone and being equipped with measuring heads which respond to register marks applied to the sheets in the first printing unit and detect register deviations in the circumferential direction and in the lateral direction, and a register correcting device, located between the detector system and the second printing unit, said device comprises a register drum and is arranged to correct the position of the sheets in dependence upon the measured register deviations.

2. Sheet fed rotary printing machine according to claim 1, wherein the register drum has its own controlled drive mechanism which is independent of the above-mentioned drive mechanisms for the printing units and which is adjustable in dependence upon the speed of the second printing unit and controllable in dependence upon the measured circumferential register deviation for the purpose of correction thereof, and a device is provided for correcting the sheet position in dependence upon the measured register deviation in the lateral direction.

3. Sheet fed rotary printing machine according to claim 2, wherein the device for correcting side register deviation is mounted on the register drum, and is arranged to displace a sheet relative to the surface of the register drum or shift the register drum axially as a whole.

4. Sheet fed rotary printing machine according to claim 2, wherein the device for correcting side register deviation is disposed between the register drum and the second printing unit.

5. Sheet fed rotary printing machine according to claim 1, wherein the detector system is moreover arranged to measure any skew of a sheet, and a controllable device is provided for correcting this skew, this device being preferably mounted on the register drum, or formed by the register drum itself which is mounted in self-aligning bearings and displaceable.

6. Sheet fed rotary printing machine according to claim 1, wherein the register drum is equipped with controllable devices for displacing a sheet relative to the drum circumference in the circumferential direction and in the lateral direction, as well as for correcting skew of the sheet if necessary.

7. Sheet fed rotary printing machine according to claim 1, wherein behind the point at which the sheets are printed in the second printing unit is disposed a second detector system with measuring heads which measure the relative positions of the register marks applied to the sheets in the first printing unit and additional register marks applied in the second printing unit, for the purpose of detecting register deviation, and the device for correcting register deviations is also controllable by this second detector system.

8. Sheet fed rotary printing machine according to claim 1, wherein the register drum is disposed between two cylinders, of which the one in front, as seen in the direction of transport, is a drying cylinder, and the one behind is a conveying drum, and the axes of these two cylinders and of the register drum are located at least approximately in a straight line.

9. Sheet fed rotary printing machine according to claim 1, wherein in front of the register drum in the conveying device is disposed an optionally adjustable sheet turning device which is known per se.

* * * * *